US011214082B2

(12) United States Patent
Teoh et al.

(10) Patent No.: US 11,214,082 B2
(45) Date of Patent: Jan. 4, 2022

(54) MEDIA DETECTORS

(71) Applicant: Hewlett-Packard Development Company, L.P., Spring, TX (US)

(72) Inventors: Wei Lit Teoh, Singapore (SG); Felicia Rezanda, Singapore (SG); Eugene Goh, Singapore (SG); Li-Wen Benedict Tan, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/634,963

(22) PCT Filed: Jul. 31, 2017

(86) PCT No.: PCT/US2017/044690
§ 371 (c)(1),
(2) Date: Jan. 29, 2020

(87) PCT Pub. No.: WO2019/027425
PCT Pub. Date: Feb. 7, 2019

(65) Prior Publication Data

US 2020/0238735 A1 Jul. 30, 2020

(51) Int. Cl.
*B41J 13/00* (2006.01)
*B65H 7/02* (2006.01)

(52) U.S. Cl.
CPC ..... *B41J 13/0009* (2013.01); *B65H 7/02* (2013.01); *B65H 2511/51* (2013.01); *B65H 2515/32* (2013.01)

(58) Field of Classification Search
CPC .... B41J 13/0009; B65H 7/02; B65H 2512/32; B65H 2511/51; B65H 2511/416; B65H 3/0661; B65H 1/00; B65H 7/01; B65H 1/04
See application file for complete search history.

(56) References Cited

U.S. PATENT DOCUMENTS

| | | | | |
|---|---|---|---|---|
| 5,552,859 | A | 9/1996 | Tomohito et al. | |
| 5,939,646 | A | 8/1999 | Fowler | |
| 6,257,569 | B1 | 7/2001 | Rhodes et al. | |
| 6,896,254 | B2 | 5/2005 | Koh et al. | |
| 7,568,850 | B2 * | 8/2009 | Bingham | B41J 13/103 271/145 |
| 7,828,282 | B2 | 11/2010 | Zhang | |
| 8,746,673 | B1 | 6/2014 | Nickerson et al. | |
| 9,221,638 | B1 | 12/2015 | Takahashi | |
| 9,531,889 | B2 | 12/2016 | Atay et al. | |
| 2004/0101344 | A1 * | 5/2004 | Jung | B41J 13/103 400/624 |
| 2004/0188917 | A1 | 9/2004 | Koh et al. | |
| 2005/0194732 | A1 | 9/2005 | Asada | |
| 2005/0275151 | A1 | 12/2005 | Marra, III et al. | |
| 2006/0087070 | A1 | 4/2006 | Cook et al. | |

(Continued)

OTHER PUBLICATIONS

HP Laserjet Enterprise 700 M712 Troubleshooting Manual ~ https://www.manualslib.com/manual ~ 2012 ~ 366 pages.

*Primary Examiner* — Sharon Polk
(74) *Attorney, Agent, or Firm* — Mannava & Kang

(57) ABSTRACT

A printing apparatus determines a change in torque of a motor that moves a pick arm for translating print media, determines based on the change in torque whether a media in present adjacent to the pick arm.

15 Claims, 10 Drawing Sheets

(56) References Cited

U.S. PATENT DOCUMENTS

| | | | |
|---|---|---|---|
| 2009/0039591 | A1 | 2/2009 | Taniguchi |
| 2010/0213664 | A1 | 8/2010 | Murray |
| 2014/0306399 | A1 | 10/2014 | Nickerson et al. |

* cited by examiner

MEDIA DETECTORS

BACKGROUND

Printing and copying devices are used to produce copies of documents. For example, a printing and copying device may obtain media, such as paper, from a media bin and produce an image and/or text onto the paper. The paper with the printed image and/or text may be provided to an output tray of the printing and copying device so that a user may obtain the printed paper from a common output area. Multiple printed sheets may be produced and provided to the output tray for retrieval by a user.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
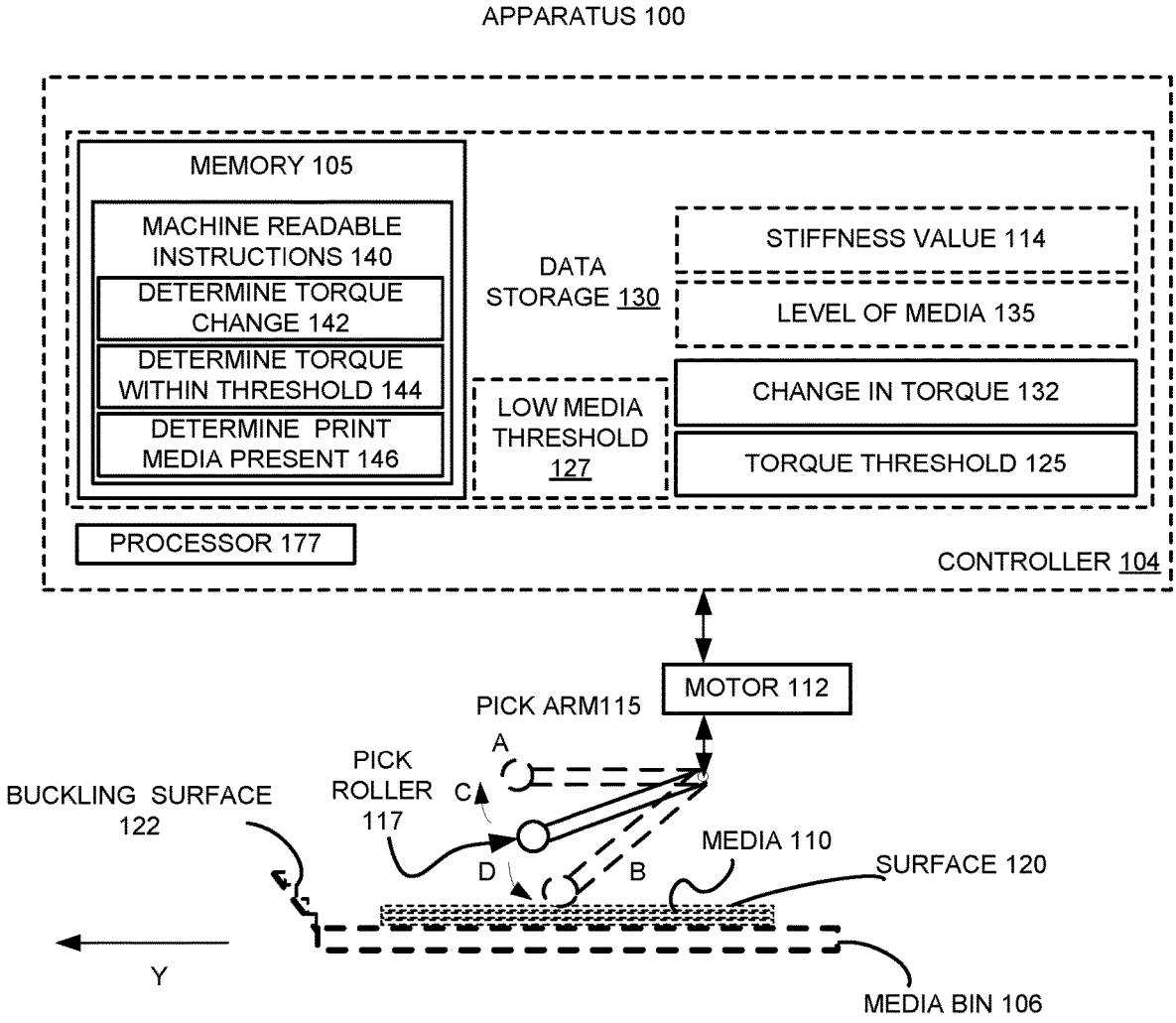
FIGS. 1A, 1B, 1C and 1D show block diagrams of an example printing apparatus.

A printing apparatus, according to an example of the present disclosure, detects presence of media in a media bin. For example, the printing apparatus determines a change in torque of a motor that powers a pick arm translating media in the media bin. The printing apparatus determines presence of the media in the media bin when the change in torque of the motor exceeds a torque threshold. The torque threshold may be based on instantaneous torque values, magnitude of torque values, slope of change in torque values or the like. In an example, the torque may be a function of the force applied by the motor to power the pick arm. The change in torque may be the change in magnitude of the torque applied by the motor over a period of time.

Similarly, the printing apparatus can determine presence of an accessory, based on a torque signature. In an example, the torque signature may be a continuous plot of the magnitude of torque applied by the motor, when the pick roller of the pick arm translates against a surface such as the media on the media bin. The apparatus may determine presence of an accessory, when the torque signature measured is similar to a reference torque signature. Examples of accessories may include media trays, finisher units, and the like.

Examples of media bin may include an input tray, an output tray, an input bin, an output bin or the like. In an example, the media bin may be a tray for collecting the media after the printing apparatus produces text and/or images on the media, such as an output media bin. In another example, the media bin may be an input media bin that holds the media prior to printing. In an example, the media bin may hold different sizes of the media. In an example, the media bin may hold print media with a specific stiffness measured in gram per square meter thickness (GSM). In an example, media may include print media. Print media may include one sheet or multiple sheets of paper. Examples of types of print media may include plain paper, glossy paper, photo paper, cardstock, etc. In an example, the pick arm may translate the media in the media bin from a rest position to a pick ready position; for example, move the media from the input tray toward a buckling surface to move the media toward rollers for further printing processes.

In an example, the torque signatures may be similar when the signatures have the same number of peaks, the magnitude of a peak are similar, etc. In an example, a peak in the torque may be described as a maximum value or a minimum value of torque in a continuous plot of values of a function of torque measured over time. Examples of continuous plot of values includes a plot of torque, plots of change in torque, plots of instantaneous torque, etc., over a measurement period.

A technical problem associated with detecting presence of the media in the media bin involves use of sensors to detect the media. The sensors may have their own housing, and placing the sensors to detect the media may involve changing the design of the tray or support structures to accommodate the sensors and or may involve changing the design of the electrical wiring associated with the sensors. The sensors may include optical sensors to detect the media in the media bin, and another technical problem is that the optical sensors may be negatively affected by dust, reflectance of media, etc. Also, another technical problem with sensor flags in input trays, output trays and the like is that they are small and fragile, which may be damaged during handling and assembly. Furthermore, adding additional sensors increases risk of failure such as mechanical failures, electrical failures and the like. Further, adding sensors increases the overall cost of the printer due to the design costs of producing a supporting structure modified to accommodate sensors, wiring of sensors, connectors on electrical circuit boards to link to the wires, assembly costs for fixing and calibrating the sensor and the like. An additional problem with sensors is how to determine whether the media bin has media on the media bin when the level of media on the media bin is less a few sheets of media.

The printing apparatus described in further detail below according to examples of the present disclosure is able to determine the presence of the media or absence of the media based on the change in torque of a motor that powers a pick arm translating media. The printing apparatus according to examples reuses a pick arm for translating media and the attached motor to also determine presence of print media and additional sensors for detection of media presence may be eliminated from the printing apparatus, reducing complexity and cost and making assembly easier. Also, the risks associated with the sensors getting damaged during handling or assembly and consequent faults in detection of presence of media is minimized because a pick arm for translating media is sturdier than mechanical flags and the like. Thus, the printing apparatus according to examples of the present disclosure may be less bulky, less complex, and less expensive compared to the printing systems with dedicated media presence sensors. Also, the present apparatus according to examples of the present disclosure may augment current sensors when the current sensors fail or are not sensitive enough to detect a few sheets of media.

With reference to FIG. 1A, the figure shows a block diagram of a printing apparatus 100, referred to hereinafter as apparatus 100, according to an example of the present disclosure. The apparatus 100 may determine presence of a media 110 based on a change in torque 132 of a motor 112 that powers pick arm 115. The apparatus 100 may be an inkjet printer or any other type of printer having the pick arm 115 for translating the media 110 on the media bin 106.

The apparatus 100 may include a controller 104, a processor 177 and machine readable instructions 140 stored in a data storage 130. The apparatus 100 may include a media bin 106 for holding media 110 and a pick arm 115 for translating media 110. In an example, the pick arm 115 may translate the media 110 on the media bin 106. In an example, the pick arm 15 may translate the media 110 into a media path of the apparatus 100 to print text, images or both. In another example, the pick arm 115 may include a pick roller 117 that may translate the media 110. The apparatus 100 may include a motor 112 for powering the pick arm 115. In an example, the motor 112 may also power roller 117. The processor 177 may execute the machine readable instructions 140 stored in the data storage 130 to perform various operations of the apparatus 100.

In an example, the controller 104 may operate the motor 112 to move the pick arm 115 between a rest position and a pick ready position. At the rest position, the pick arm 115 may be retracted away from the media bin 106 and is not in contact with the media 110. At the pick ready position, the pick arm 115 may remain in contact with media 110 present in the media bin 106 and may be operated to translate media on the media bin 106. In an example, the rest position may be parallel to the media bin 106. In an example, the controller 104 may determine the torque applied by the motor 112 to the pick arm 115 based on the current drawn by the motor 112. In an example, the pick arm 115 may remain in the pick ready position during the printing operation. In an example, the pick arm 115 may remain in the rest position when the apparatus 100 is in the idle state and no printing operation is being carried out by the apparatus 100. The position A of the pick arm may be the rest position.

In an example, the motor 112 may be a pick motor coupled to the pick arm 115. In another example, the motor 112 may be a multi-purpose motor that may operate as a feed motor for feeding media to a printing unit shown in FIG. 2 of the printing apparatus 100 and also operate as a pick motor coupled to the pick arm, to drive the pick arm 115. In an example, the motor 112 may be connected to the pick arm 115 through a cam arrangement (not shown). The controller 104 may rotate the motor 112 and move the cam arrangement resulting in movement of the pick arm 115 between position A and position B as show in FIG. 1. In another example, the motor 112 may drive a pick roller 117 at one end of the pick arm 115 to feed the printing unit by translating the media 110.

In an example, the controller 104 may include an encoder (not shown). The encoder may be a rotary encoder. The encoder may be coupled to a shaft of the motor 112 and may indicate angular position of the shaft of the motor 112 in terms of an encoder count which may be stored in a memory 105 by the controller 104. In an example, the controller 104 may measure an output torque of the motor 112. In an example, the controller 104 may generate control instructions in a Pulse Width Modulation (PWM) scheme to rotate the motor 112. The controller 104 may use the encoder to determine the location of the pick roller 117 in relation to the structure of the printer such as side wall, buckling means discussed further below and the like. The controller 104 may use this information to make adjustments based on the location of the pick roller 117.

In an example, the controller 104 may rotate the pick arm 115 in the direction indicated by the arrow D from the rest position A toward the pick ready position B. The media 110 may arrest the pick arm 115 at the pick ready position B. When the pick arm 115 is at the pick ready position B, the pick roller 117 may rotate to transfer the media 110 toward the direction indicated by the arrow Y. In an example, the pick roller 117 may rotate to translate the paper toward the buckling surface 122. Examples of the buckling surface 122 may include sheet separators, side wall of media bins, walls at an angle to buckle the media, and the like. Examples of buckling surface 122 may use rubber pads such as gull-wings, surfaces at angles sufficient to separate a media from another. The buckling surface 112 is shown by way of example as a serrated surface, but the buckling surface 112 may be polished surface, unpolished surface, surface at an angle or the like that may buckle the media 110. The operation of moving the media 110 toward the buckling surface 122 to buckle the media 110 may be termed a micro pick. In an example, the controller 104 may push the media 110 3-5 millimeters (mm) up the buckling surface 122 such as the serrated wall to perform a micro pick and obtain a torque response.

The controller 104 may calculate a change in torque 132 of the motor 112 that powers pick roller 117 when the media 110 buckles against the buckling surface 122. The pick roller 117 may translate the media 110 in the media bin 106 toward a media path to print text, images or both. In an example, the controller 104 may determine the change in torque 132 when the pick roller 117 rotates a specific number of rotations to translate the media 110 on the media bin 106. The controller 104 may determine whether the change in torque 132 of the motor 112 is within a torque threshold 125. In response to the change in torque 132 being within the torque threshold 125, the controller 104 may determine that the media 110 is present adjacent to the pick arm 115. In another example, the controller 104 may determine the media 110 is present based on the magnitude of change in torque. In another example, the controller 104 may determine the media 110 is present based on the slope of the change in torque.

In an example, the torque threshold 125 may be based on a minimum change in torque 132 when media 110 is present on the media bin 106 and a maximum change in torque 132 when media 110 is present on the media bin 106. For example, as described below with reference to FIG. 3, the minimum change in torque may identify a media with low stiffness value such as 80 grams per square meter (gsm) paper, whereas the maximum change in torque may identify a cardstock with a high stiffness value. In an example, media 110 may be on the media bin 106 adjacent to the pick arm 115. In an example, when the controller 104 determines that the media 110 is present on the media bin 106, the controller 104 may reset the media 110 translated during media detection on the media bin 106.

The controller 104 may determine whether the media 110 in the media bin 106 is less than a low media threshold 127 before performing a micro pick operation to minimize use of the pick arm 115 and prolong the life of the pick arm 115 and related assembly. The controller 104 may obtain level of media 135 information from a previous micro pick operation. The controller 104 may then lower the pick arm 115 from the rest position A to the pick ready position B. The controller 104 may translate the media 110 in the y direction until the media 110 buckles against the buckling surface 122. The controller 104 may then determine as described above the change in torque from the time instance the motor 112 was activated to the instance the media 110 buckles. In response to the change in torque being within the torque threshold 125, the controller 104 may determine the presence of the media 110 on the media bin 106. In another example, at position B the pick arm 115 may include a pick roller 117 that may be in contact with the media 110. The controller may drive the pick roller 117 using the motor 112, and the motion of the roller 117 may translate the media 110 and the media 110 may buckle against the buckling surface.

In another example, the controller 104 may determine the level of media in a media bin 106 is less than a low media threshold 127. The controller 104 may move the pick arm 115 laterally in the direction indicated by Y to move the media 110. The end of the pick arm 115 touching the media 110 may frictionally move the media 110. In an example, a cam attached to the pick arm 115 may be used to laterally move the pick arm 115. The controller 104 may translate the media 110 in the y direction until the media 110 buckles between a pick arm and the buckling surface 122.

The controller 104 may determine the change in torque 132 as the media 110 buckles. In an example, the controller 104 may move the motor 112 at a rotational speed to allow monitoring of the torque response from the motor 112 as the media 110 buckles. The controller 104 may determine a stiffness value of media on the media bin 106 based on the change in torque 132. For example, the controller 104 may use the magnitude of change in torque to determine the stiffness value. In an example, the stiffness value K is a function of elastic modulus and an area moment of inertia I of a beam cross-section about an axis of interest, length of a beam and beam boundary condition. The beam may be a cross-section of the media 110, such as a thickness of a sheet of paper in the media bin 106. The controller 104 may then determine the type of media 110 based on the stiffness value 114 of the media 110.

In an example, the controller 104 may determine the change in torque 132 when the pick arm 115 is resting against an accessory. Examples of accessories may include additional media trays, finisher units and the like. The controller 104 may determine a change in torque by moving the pick arm 115 using the motor 112 laterally in the direction y. In another example, the controller 104 may determine a change in torque by rotating the pick roller 117 at position B using the motor 112.

The controller 104 may determine whether the change in torque 132 is within a threshold for the accessory or the media bin 106. For example, the controller 104 may determine whether the change in torque 132 has a positive linear slope to identify media 110. In another example, the controller may determine whether the change in torque 132 has a negative linear slope to identify an accessory or the media bin 106. In another example, the controller 104 may determine the magnitude of the change in slope to determine whether the accessory or the media bin 106 is present. In another example, the controller 104 may use a look up table stored in the data storage 130 with different torque magnitude values and different surfaces corresponding to the different torque magnitude values. The controller 104 may determine the identity of the surface 120 on which the pick arm 115 is resting based on the look up table.

In an example, the controller 104 may determine an accessory such as the media bin is present based on the torque signature of the motor. The controller 104 may determine a signature by measuring the change in torque as the pick arm 115 rests on the surface of the accessory. The controller 104 may then determine the signature of the torque as a plot of the change in torque over time. For example, the controller 104 may determine the signature from the instant in time the pick arm 115 touches the accessory to the time a change in torque is detected. The controller 104 may determine whether the determined torque signature is similar to a reference torque signature. In response to a determination that the torque signature of the motor matches the reference torque signature the controller 104 may determine that an accessory is present. In an example, to determine the torque signatures are similar, the controller 104 may determine the number of peaks in the torque signature is the same as the number of peaks in the reference torque signature. In response to the determination that the number of peaks are the same, the controller 104 may determine the torque signatures match. In an example, the controller 104 may determine the signatures are similar when the magnitude of the peak in the signature determined by the controller 104 is similar to the magnitude of a peak in the reference signature. Examples of peaks may include the highest or the lowest values of a function of torque plotted against time.

The data storage 130 may include a non-transitory computer readable medium storing the machine readable instructions 140 that are executable by the controller 104. In an example, the processor 177 may retrieve the machine readable instructions 140 from the data storage 130 to execute the machine readable instructions 140. At 142, the processor 177 may determine change in torque of the motor 112. At 144, the processor 177 may determine whether the change in torque is within the torque threshold. At 146, the processor 177 may determine whether print media is present.

Figure 1B:
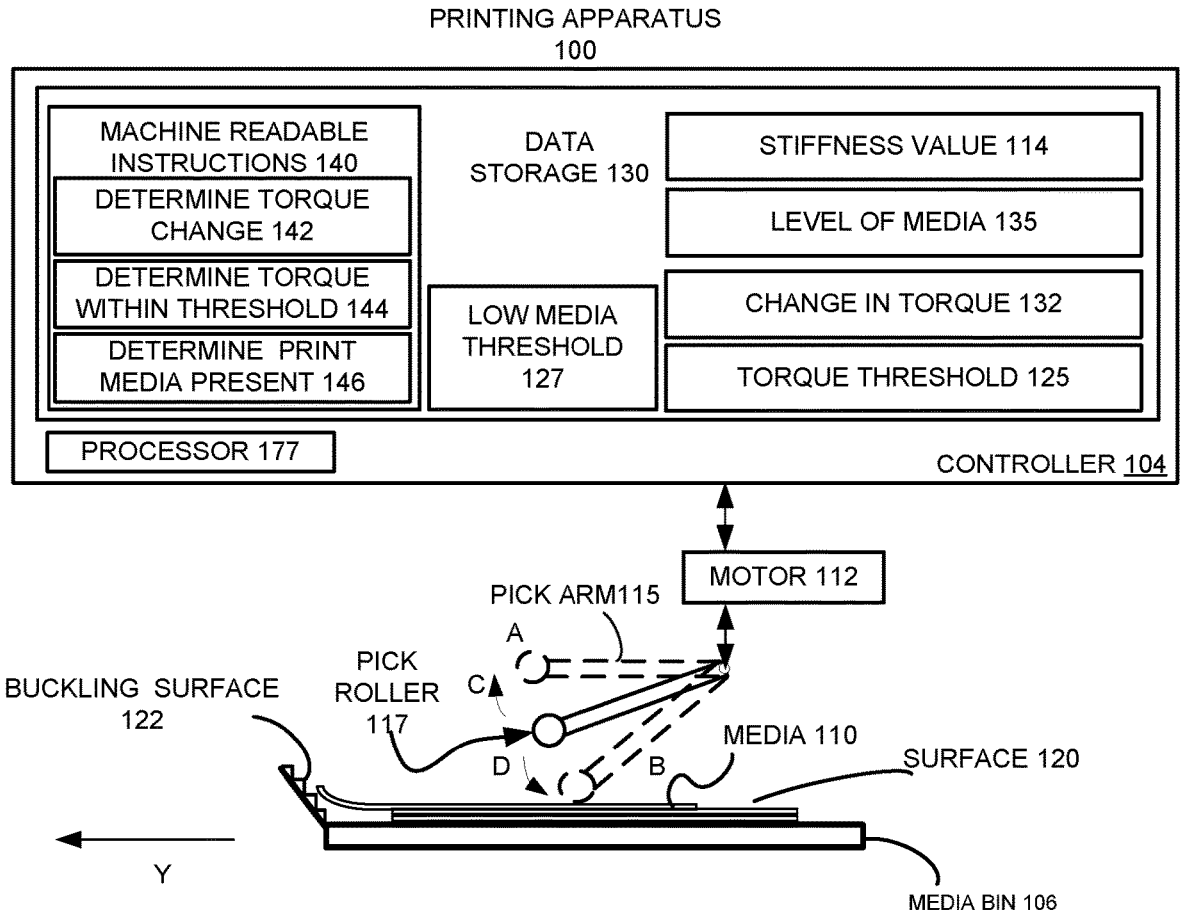

With reference to FIG. 1B, the figure shows the media 110 buckling against the buckling surface 122 opposite the pick arm 115. In an example, the buckling surface 122 may have serrations to separate the media such as sheets of paper. The buckling surface 122 may be positioned such that the media 110 buckles when the media is pushed towards the surface by the pick roller 117. For example the buckling surface 122 may be at an angle such that the media 110 buckles.

Figure 1C:
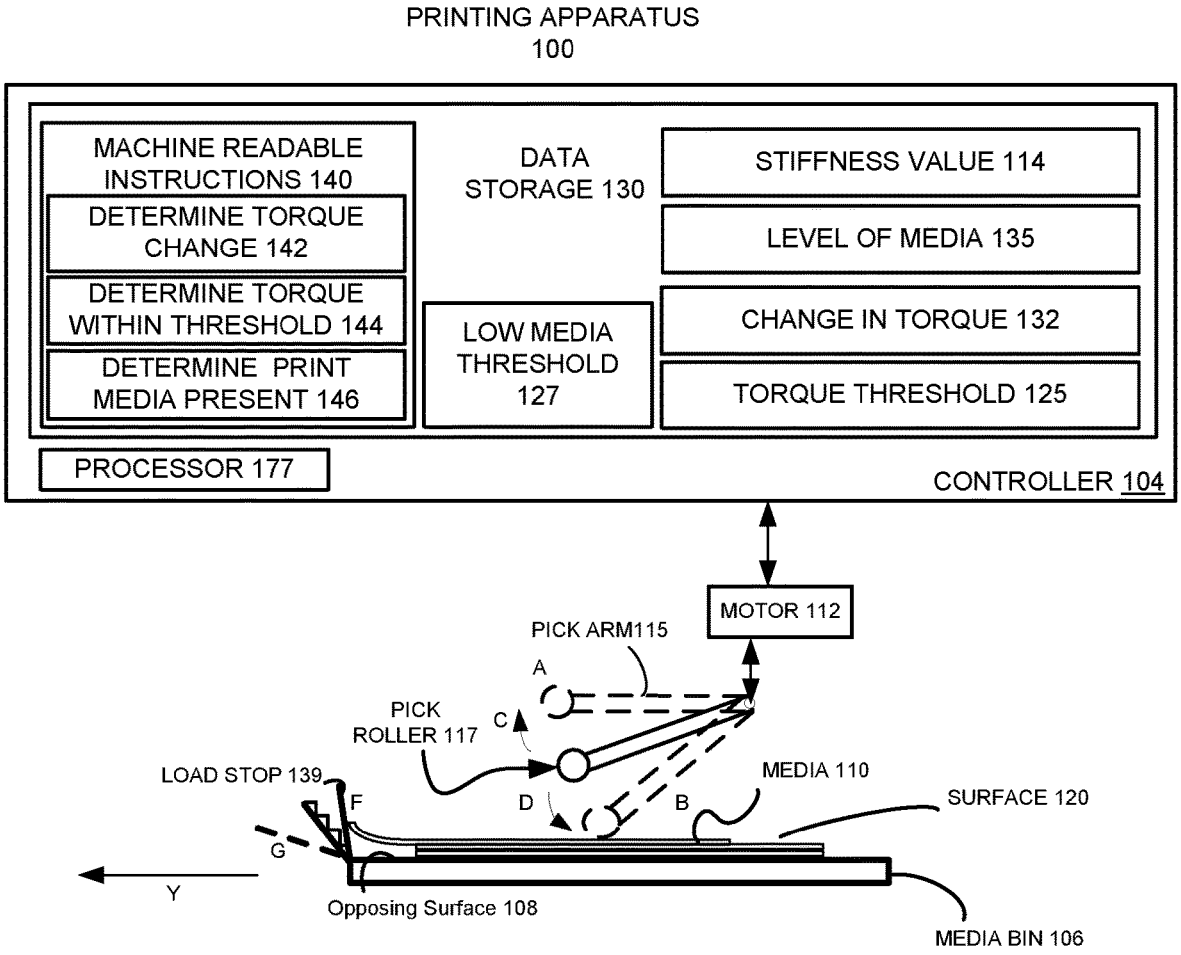

With reference to FIG. 1C, the figure shows a load stop 139 opposite the pick arm 115. The load stop 139 may move from position G towards position F around a pivot as shown in FIG. 1C. In an example, the controller 104 may use the load stop 139 to reset the media 110 by moving the load stop from position G towards position F around a pivot. The movement of the load stop 139 against the media 110 may translate the media 110 opposite to the direction shown by Y. The controller 104 may in response to a determination that media 110 is present on the media bin 106, reset the media 110 translated during the media detection in the media bin 106. As shown in the figure, the load stop 139 may pivot around an axis moves to push the media 110 back after detection. In an example, the load stop 139 may push the media 110 such that the force on the media 110 has a larger component of the force acting in the y direction that is larger than the force acting perpendicular to the y component to move the media bin 106 back, instead of bending the media 110. The controller 104 may rest the media to ensure the next translation feeds the media 110 to the right location. Also, further media detection may require resets.

Figure 1D:
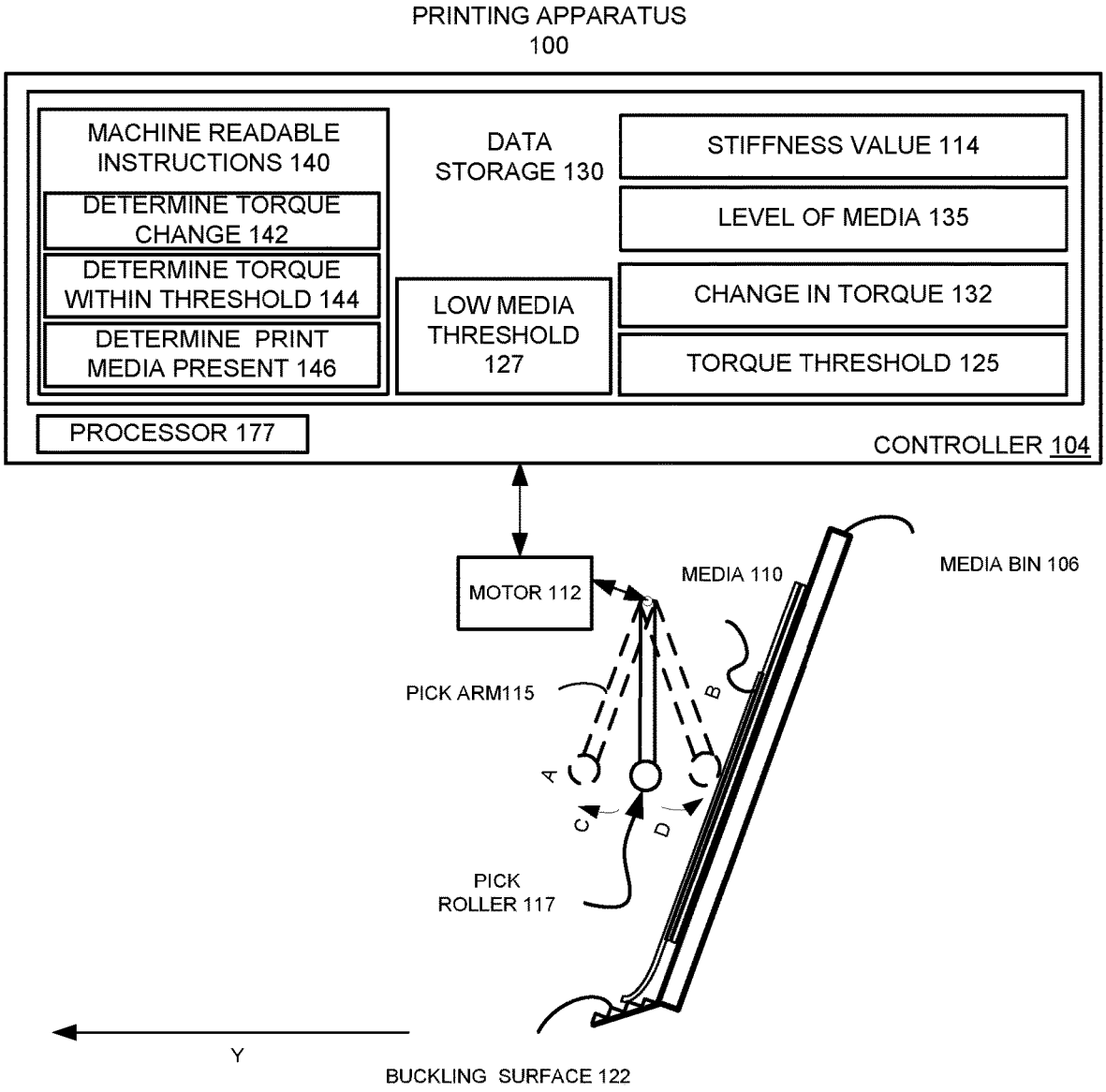

With reference to FIG. 1D, the figure shows that the media bin 106 may be provided at a different angle than shown in FIGS. 1A-C, and the. In an example, the print media may be fed from the top of the apparatus 100 as shown. The buckling surface 122 may be present at the bottom of the apparatus 100. In an example, the buckling surface 122 may be at an angle that allows the media 110 to buckle with a smooth surface.

Figure 2:
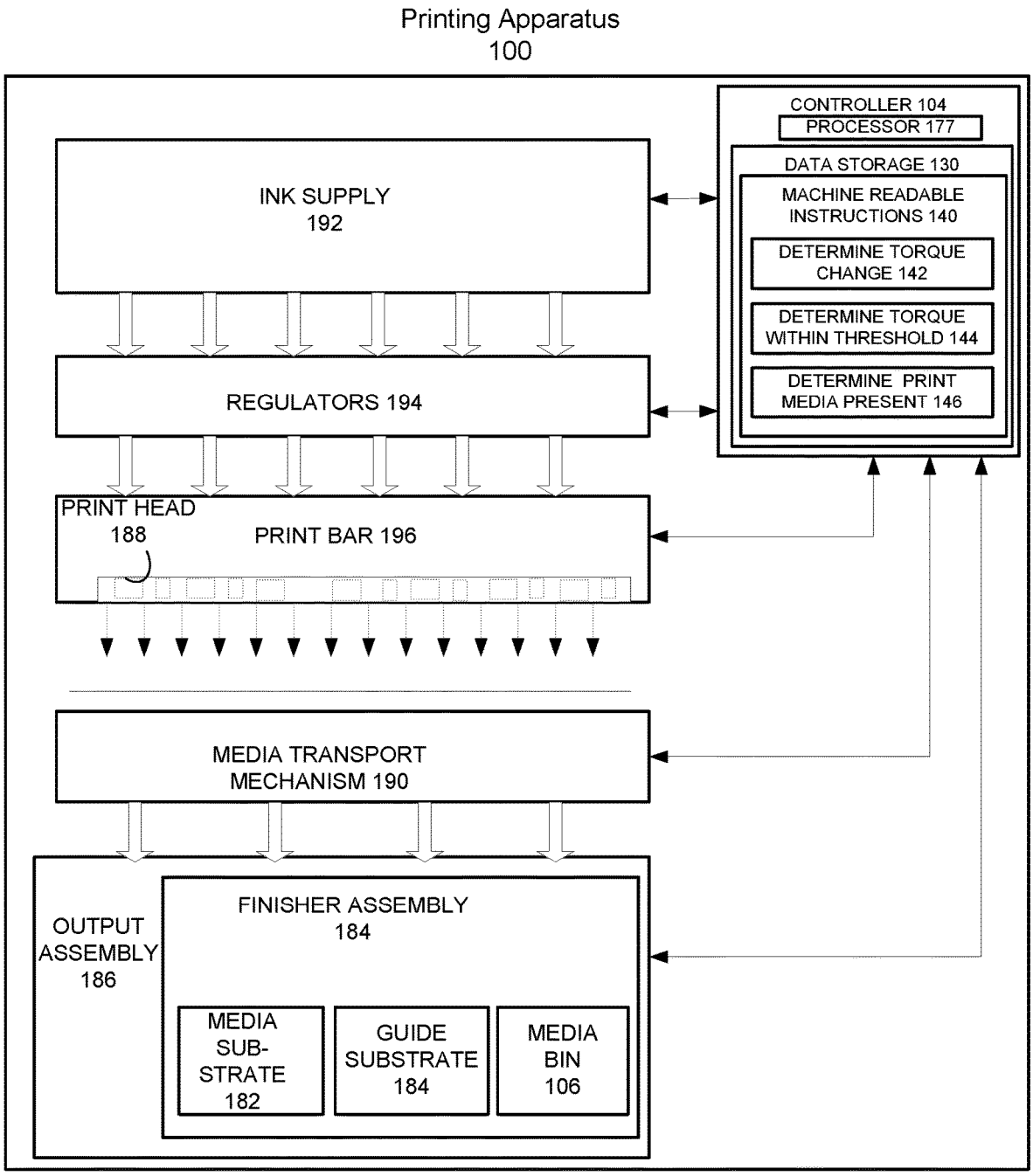
FIG. 2 shows components that may be used in the printing apparatus according to an example.

FIG. 2 shows an example of components of the apparatus 100. The apparatus 100 includes the media bin 106 to receive the media 110. In an example, the apparatus 100 may receive a number of stacks of the media 110. In another example, the apparatus 100 may include a print bar 196 that spans the width of the media 110. In another example, the apparatus 100 may include non-page wide array print heads. The apparatus 100 may further include flow regulators 194 associated with the print bar 196; a media transport mechanism 190, printing fluid or other ejection fluid supplies 192 and the controller 104. Although a 2D printing apparatus is described herein and depicted in the accompanying figures, aspects of the examples described herein may be applied in a 3D printing apparatus.

The controller 104 may represent the machine readable instructions 140, processor(s) 177, associated data storage(s) 130, and the electronic circuitry and components used to control the operative elements of the apparatus 100 including the firing and the operation of print heads 188, including the print bar 196. The controller 104 includes hardware such as an integrated circuit, e.g., a microprocessor. In other examples, the controller 104 may include an application-specific integrated circuit, field programmable gate arrays or other types of integrated circuits designed to perform specific tasks. The controller 104 may include a single controller or multiple controllers. The data storage 130 may include memory and/or other types of volatile or nonvolatile data storages. The data storage 130 may include a non-transitory computer readable medium storing machine readable instructions 140 that are executable by the controller 104. In an example, the controller 104 may retrieve the machine readable instructions 140 from the data storage 130 to execute the instructions. At 142, the controller 104 may determine change in torque of the motor 112. At 144, the controller 104 may determine whether the change in torque is within the torque threshold. At 146, the controller 104 may determine whether print media is present.

Further, the controller 104 controls the media transport mechanism 190 used to transport media through the apparatus 100 during printing and to transport the media 110 to the media bin 106. In an example, the controller 104 may control a number of functions of the media bin 106. Further, the controller 104 controls functions of a finisher assembly 184 to translate a number of stacks of the media 110 between different locations within the output area.

The media transport mechanism 190 may transport the media 110 from the media bin (not shown in figure) for feeding paper into the printing apparatus 100 to the output assembly 186 used for collection, registration and/or finishing of the media 110. In an example, the media 110 collected on the output assembly 186 includes at least one of the media 110 having text and/or images produced. In an example, a completed collection of the media 110 may represent a print job that the apparatus 100 processes.

The apparatus 100 may be any type of device that reproduces an image onto the media 110. In one example, the apparatus 100 may be an inkjet printing device, laser printing device, a toner based printing device, a solid ink printing device, a dye-sublimation printing device, among others. Although the present printing apparatus 100 is describe herein as an inkjet printing device, any type of printing apparatus may be used in connection with the described systems, devices, and methods described herein. Consequently, an inkjet printing apparatus 100 as described in connection with the present specification is meant to be understood as an example and is not meant to be limiting.

Figure 3:
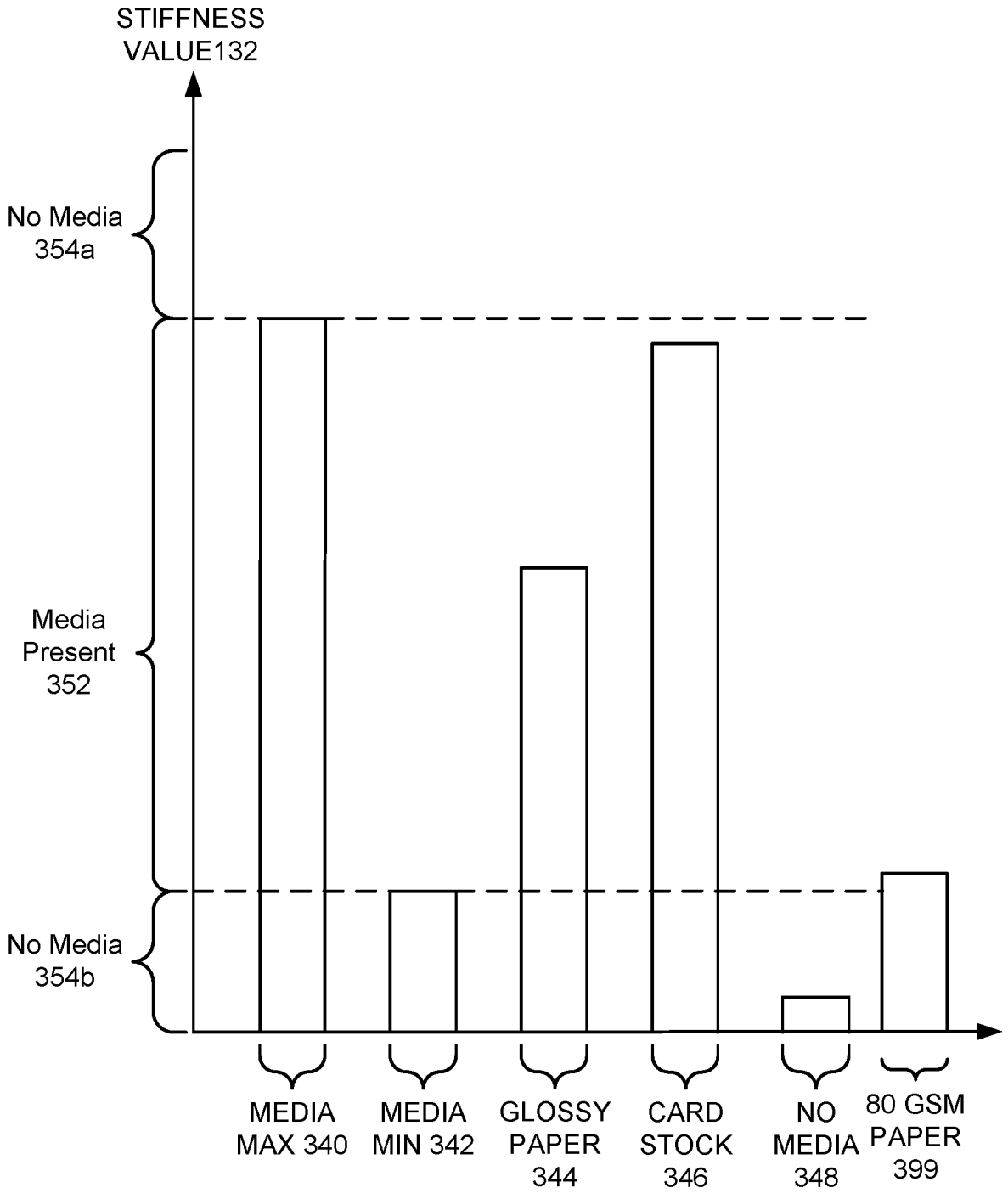
FIG. 3 shows an example histogram of stiffness values.

FIG. 3 shows an example histogram of stiffness values for media 110 according to examples of the present disclosure. The controller 104 may use these relationships in the form of threshold values in the apparatus to determine and perform various operations of the apparatus. In an example, the histogram depicts the stiffness value 114 of the media 110 when buckled between the pick arm 115 and the buckling surface 122. In an example, different types of media 110 may have different stiffness values. For example, different types of papers such a glossy 344, 80 GSM paper 399, cardstock 346 etc., may have different stiffness values. In an example, the media 110 on the media bin 106 may have a maximum stiffness value 340 and a minimum stiffness value 342 as shown in the histogram. The controller 104 may use the values such as the maximum and minimum stiffness values for media 110 as thresholds. In an example, the controller 104 may determine presence of media 110, when the stiffness value 114 determined by the controller 104 is between the maximum stiffness value 340 and the minimum stiffness value 342. In examples, the maximum and minimum stiffness values may be substituted with instantaneous torque values, slope of the change of torque values, magnitude of change of torque values and the like to determine the thresholds. In another example, the controller 104 may determine absence of the media 110, when the stiffness value 114 determined by the controller 104 is below the minimum stiffness value 342 or above the maximum stiffness value 340 of the media 110.

In an example, the media 110 on the media bin 106 may be a glossy paper 344. The glossy paper 344 may have a stiffness value 344 as shown in the histogram, which may be lower than the maximum stiffness value 340 and higher than the minimum stiffness value 342 for different media 110. In another example, the media 110 on the media bin 106 may be a cardstock and may have a stiffness value of 346. The cardstock may have a stiffness value 346, which may be higher than the minimum stiffness value 342 of the media 110. In another example, when no media is present the slope of change in torque may be lower than the minimum media 340 stiffness value of 342. In another example, controller 104 may use similar relationships that may be tabulated and values stored in the data storage 130 for accessories of the printer. In an example, the controller 104 may determine presence or absence of the media 110 based on the stiffness value measured. In an example, the controller 104 may determine presence or absence of media 110 based on the torque signature. In another example, the controller 104 may determine presence or absence of media 110 based on the slope of the change in torque.

Figure 4:
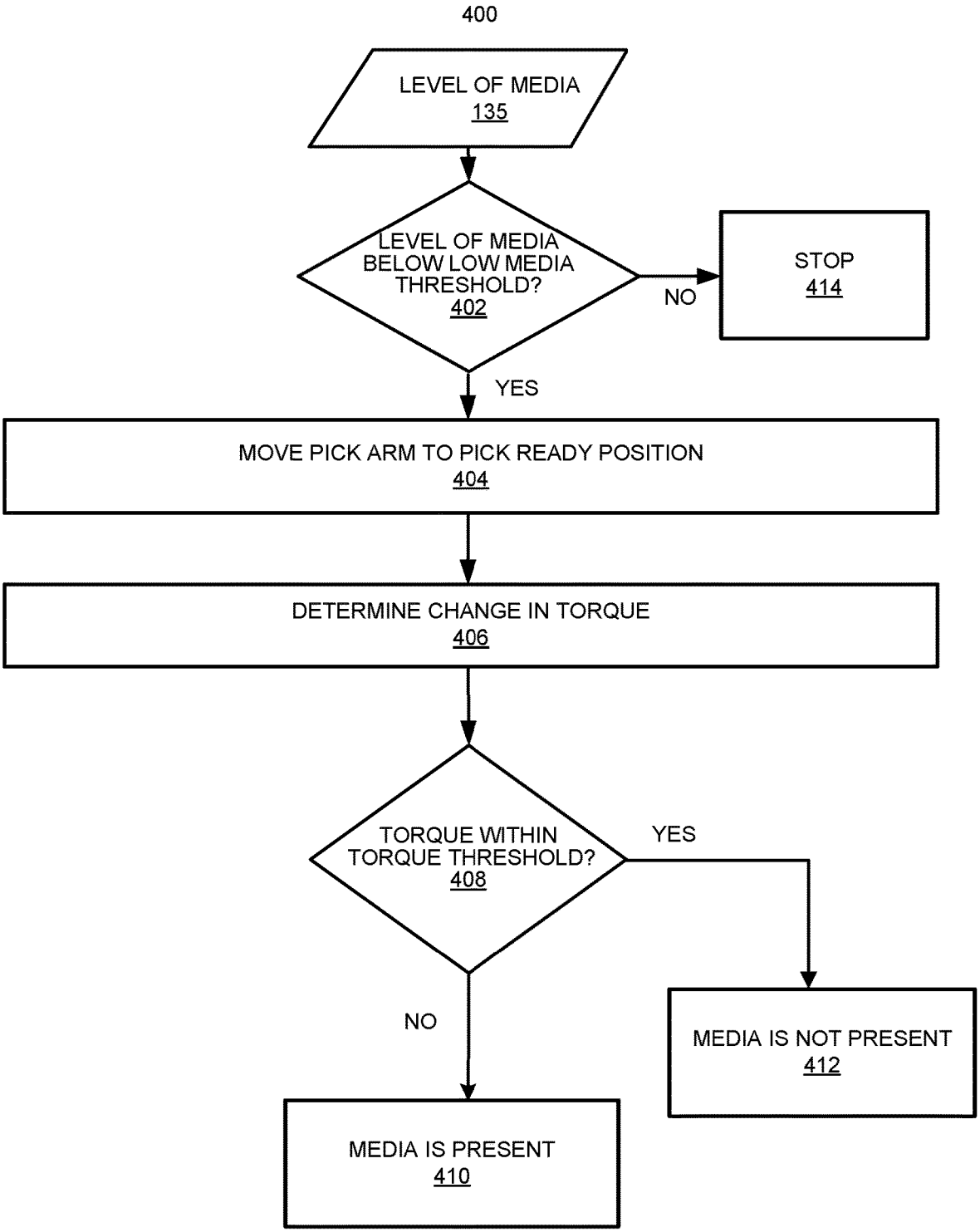
FIG. 4 shows a flow chart of an example method for detecting presence of media.

FIG. 4 shows an example of a method 400. The method 400 may be performed by the apparatus 100 to determine whether the media bin 106 is empty, to determine whether the media 110 is present in the media bin 106. The method 400 is described by way of example as being performed by the apparatus 100, and may be performed by other apparatus. The method 400 and other methods described herein may be performed by any printing apparatus including at least one processor executing machine readable instructions embodying the method. For example, the apparatus 100 and/or the controller 104 shown in FIG. 1 may store machine readable instructions in the data storage 130 embodying the methods, and a processor in the controller 104 may execute the machine readable instructions. Also, one or more of the steps of the method 400 and steps of other methods described herein may be performed in a different order than shown or substantially simultaneously.

At 402, the controller 104 may determine whether a level of media 135 in the media bin 106 is below a low media threshold. For example, the controller 104 may retrieve the information about the level of media 135 based on prior determinations of the level of media 135 stored in the data storage 130. The controller 104 may stop execution to prolong the life of the pick arm 110 and related assembly, when the controller 104 determines the level of media 135 is above the low media threshold.

At 404, the controller 104 may move the pick arm 115 from position A to position B as described with respect to FIG. 1 to touch the surface opposite to the pick arm 115 such as the media 110 if the level is below the threshold.

At 406, the controller 104 may determine a change in torque during experienced by the motor 112. In an example, the controller 104 may determine the torque change during a micro pick move as described with reference to FIG. 1.

At 408, the controller 104 may determine whether the change in torque is within the torque threshold. In an example, the torque threshold may be the magnitude of torque at a minimum and maximum stiffness value as discussed above with reference to FIG. 3. And the change torque is within the torque threshold when the change in torque is within the maximum and minimum stiffness value. The controller 104 may detect the media 110 is not present when the determined change in torque is not within the torque threshold and move to 410 to report media 110 is present. The controller 104 may detect the media 110 is present. In an example, torque is not within a threshold when the change in torque is outside the maximum and minimum stiffness value. In another example, torque is within the torque threshold, when the signature of the change in torque is similar to the signature of the torque signature of the media 110.

At 412, the controller 104 may report media 110 is not present. In an example, the controller 104 may report media 110 is not present on a display. In another example, the controller 104 may alert the user that media 110 is not present by flashing a light emitting diode. In another example, the controller 104 may transmit a message to a device connected to the apparatus 100 to alert the user.

Figure 5:
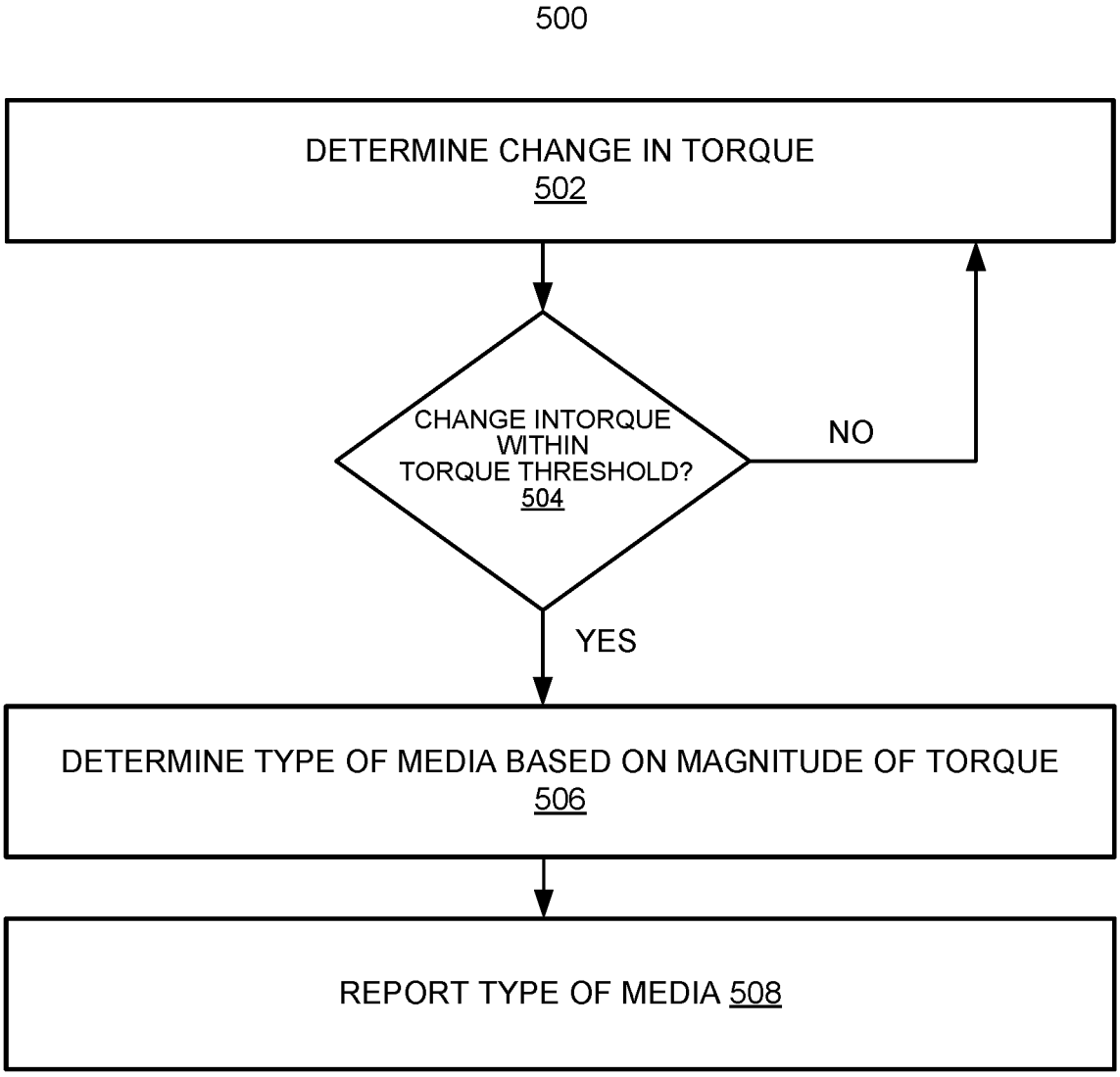
FIG. 5 shows a flow chart of an example method for determining type of media.

FIG. 5 shows an example of a method 500. The method 500 may be performed by the apparatus 100 to determine the type of media 110 in the media bin 106.

At 502, the controller 104 may determine the change in torque of motor 112 for the media 110 as discussed with reference to FIG. 1.

At 504, the controller 104 may determine whether the change in torque is within torque threshold. In an example, the change in torque may be within the torque threshold, when the measured change in torque is within a maximum and minimum magnitude of torque for media 110 as discussed with referenced to FIG. 3.

At 506, the controller 104 may determine the magnitude of change in torque. For example, assume media 110 is one sheet of 60 gsm paper the magnitude of torque of the one sheet is less than that of a 75 gsm plain paper. Similarly, the magnitude of change in torque of a 120 gsm paper is less than the magnitude of torque of the 250 gsm photo paper. In an example, the torque during a micro pick in relation to the servo position during micro pick will increase as the media thickness increases. In another example, the torque during a micro pick may present no response or a negative response when no media is present.

At 508, the controller 104 may report the type of media. In an example, the controller 104 may alert the user based on the type of media. Examples of alerts may include visual display on a screen, audible alerts, messages to mobile devices attached to the phone or the like.

Figure 6:
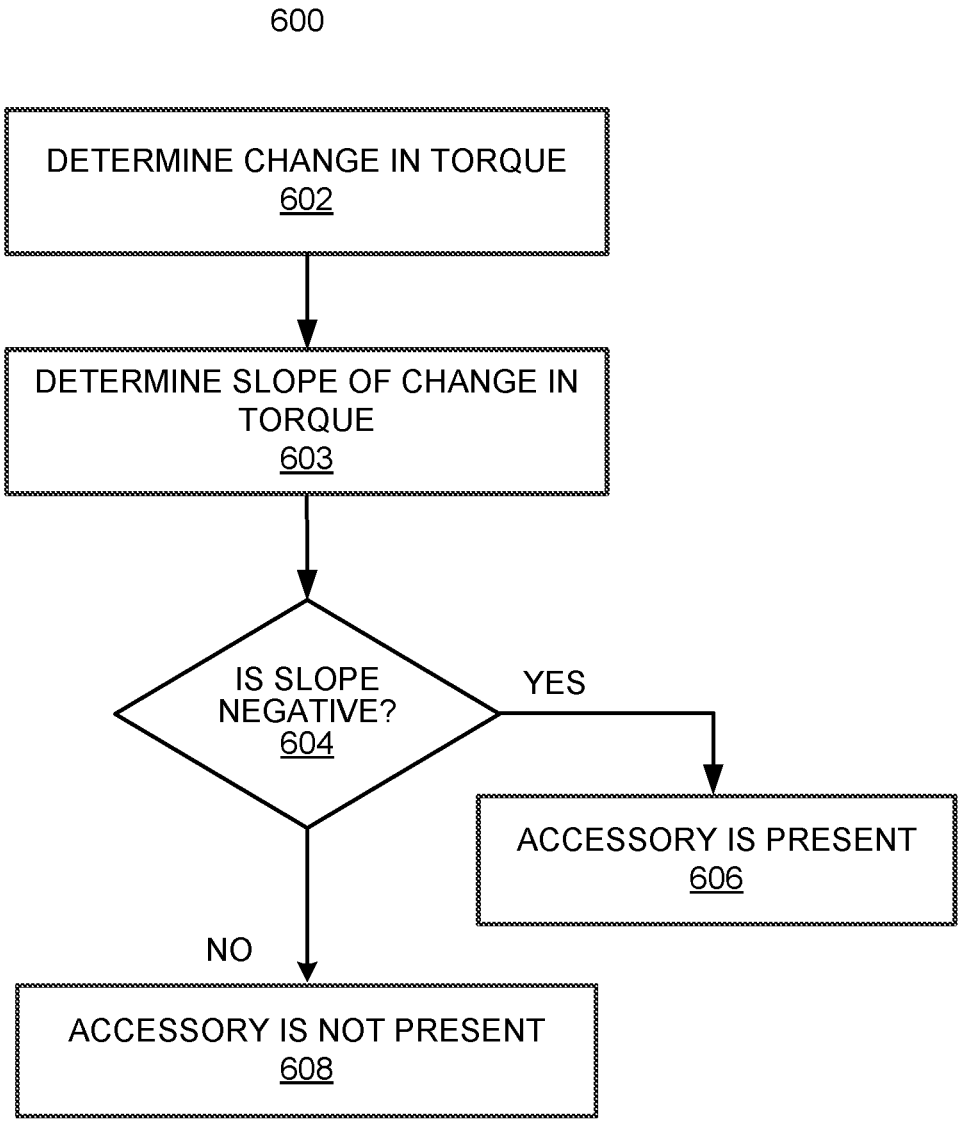
FIG. 6 shows a flow chart of an example method for detecting presence of an accessory.

FIG. 6 shows an example of a method 600. The method 600 may be performed by the apparatus 100 to determine type of accessory or presence of accessory.

At 602, the controller 104 may determine the change in torque of motor 112 as discussed with reference to FIG. 1.

At 604, the controller 104 may determine whether the change is torque is within a threshold. In an example, the change in torque is within a threshold when the negative torque has a linear slope. When the change in torque is within the threshold the controller 104 may report the tray is present at 608. Also, the controller 104 may report the media 110 is not present. In an example, when the change in torque is not within the threshold, the controller may determine tray is absent.

At 606, the controller 104 may report the tray is absent.

Figure 7:
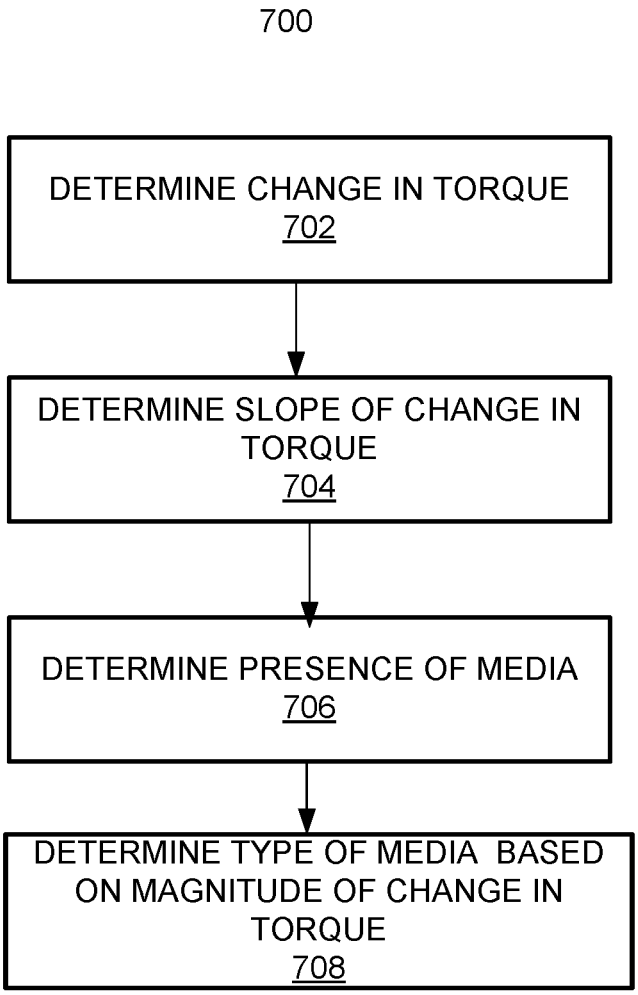
FIG. 7 shoes a flow chart of another example method for determining type of media.

FIG. 7 shows an example of a method 600. The method 600 may be performed by the apparatus 100 to determine type of accessory or presence of accessory.

At 702, the controller 104 may determine the change in torque of motor 112 as discussed with reference to FIG. 1.

At 704, the controller 104 may determine the slope of change in torque. The slope of change in torque may indicate whether media is present due to the difference in the force excreted by the motor 112 over time for media compared to other surfaces.

At 706, the controller 104 may determine whether the media 110 is present based on the slope of change in torque. In an example, the slope of change in torque may be positive when media 110 is present. In another example, the slope of change in torque may be different between media 110 and no media.

At 708, the controller 104 may determine a magnitude of change in torque. For example, the controller 104 may determine the magnitude of change in torque using the change in torque values.

At 710, the controller 104 may determine the type of media based on the magnitude of change in torque. Examples of reporting may include a message on the screen of a printer, an audible alert, a visual alert such as an illumination source on the printer flashing and the like.

What has been described and illustrated herein are examples of the disclosure along with some variations. The terms, descriptions and figures used herein are set forth by way of illustration only and are not meant as limitations. Many variations are possible within the scope of the disclosure, which is intended to be defined by the following claims—and their equivalents—in which all terms are meant in their broadest reasonable sense unless otherwise indicated.

What is claimed is:

1. A printing apparatus comprising:

a media bin to store media;

a pick arm;

a motor to power the pick arm to translate the media from the media bin for printing;

a processor; and a memory on which is stored machine readable instructions that are executable by the processor to:

determine a change in a torque of the motor;

determine whether the change in the torque of the motor is within a torque threshold;

in response to the change in the torque of the motor being within the torque threshold, determine that the media is present in the media bin;

based on the change in the torque of the motor, determine a stiffness value of the media in the media bin; and based on the stiffness value of the media, determine a type of the media in the media bin.

2. The printing apparatus of claim 1, wherein the instructions are further to cause the processor to:

determine whether a level of the media in the media bin is less than a low media threshold;

in response to a determination that the level of the media in the media bin is less than the low media threshold, lower the pick arm from a rest position to a pick-ready position; and translate the media from the media bin until the media buckles against a buckling surface opposite the pick arm.

3. The printing apparatus of claim 1, wherein the instructions are further to cause the processor to:

determine whether a level of the media in the media bin is less than a low media threshold; and in response to a determination that the level of the media in the media bin is less than the low media threshold, control a pick roller to buckle the media in the media bin between the pick arm and a buckling surface opposite the pick arm.

4. The printing apparatus of claim 1, wherein the instructions are further to cause the processor to:

in response to the determination that the media is present in the media bin, move a load stop from a first position that allows the media to be translated by the pick arm to a second position that stops the media from being translated by the pick arm.

5. The printing apparatus of claim 1, wherein the instructions are further to cause the processor to:

determine, based on the change in the torque, whether an accessory is present.

6. The printing apparatus of claim 1, wherein the instructions are further to cause the processor to:

determine, based on the change in the torque, whether the media bin contains no media.

7. The printing apparatus of claim 1, wherein the instructions are further to cause the processor to:

determine, based on the change in the torque, whether the media bin is present or is not present.

8. The printing apparatus of claim 1, further comprising:

determine a slope of the change in the torque of the motor; and based on the slope of the change in the torque of the motor, determine the presence of the media on the media bin.

9. The printing apparatus of claim 1, wherein the instructions are further to cause the processor to:

determine a magnitude of the change in the torque of the motor; and determine the type of the media based on the magnitude of the change in the torque.

10. The printing apparatus of claim 1, wherein the instructions are further to cause the processor to:

in response to the determination that the media is present in the media bin, determine that the media is present adjacent to the pick arm.

11. The printing apparatus of claim 1, wherein the instructions are further to cause the processor to:

in response to a determination that the media is not present in the media bin, determine a magnitude of the change in the torque; and determine presence of an accessory.

12. A printing apparatus comprising:

a media bin to store media;

a pick arm;

a motor to power the pick arm to translate the media from the media bin for printing;

a processor; and a memory on which is stored machine readable instructions that are executable to cause the processor to:

determine a torque signature of the motor;

determine whether the torque signature of the motor matches a reference torque signature, wherein to determine whether the torque signature of the motor matches the reference torque signature, the instructions cause the processor to:

determine whether the torque signature of the motor has a same number of peaks as the reference torque signature, and in response to a determination that the torque signature of the motor has the same number of peaks as the reference torque signature, determine that the torque signature of the motor matches the reference torque signature; and in response to the determination that the torque signature of the motor matches the reference torque signature, determine that an accessory is present.

13. The printing apparatus of claim 12, wherein the accessory is a media tray.

14. The printing apparatus of claim 12, wherein to determine whether the torque signature of the motor matches the reference torque signature, the instructions are further executable to cause the processor to:

determine whether a magnitude of one of the peaks in the torque signature of the motor is similar to a magnitude of one of the peaks in the reference torque signature; and in response to a determination that the magnitude of one of the peaks in the torque signature of the motor is similar to the magnitude of one of the peaks in the reference torque signature, determine that the torque signature of the motor matches the reference torque signature.

15. A method comprising:

determining a torque change of a motor, the motor being to translate a pick arm for translating media from a media bin;

determining a slope of the torque change;

determining a presence of the media on the media bin based on the slope of the torque change;

determining a magnitude of the torque change; and determining a type of the media based on the magnitude of the torque change.

* * * * *